US010508534B2

(12) United States Patent
Guner et al.

(10) Patent No.: US 10,508,534 B2
(45) Date of Patent: Dec. 17, 2019

(54) PLANNING AND REAL TIME OPTIMIZATION OF ELECTRODE TRANSMITTER EXCITATION

(71) Applicant: Halliburton Energy Services, Inc., Houston, TX (US)

(72) Inventors: Baris Guner, Houston, TX (US); Burkay Donderici, Houston, TX (US); Ilker R. Capoglu, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 53 days.

(21) Appl. No.: 15/533,520

(22) PCT Filed: Sep. 28, 2016

(86) PCT No.: PCT/US2016/054042

§ 371 (c)(1),
(2) Date: Jun. 6, 2017

(87) PCT Pub. No.: WO2018/063169

PCT Pub. Date: Apr. 5, 2018

(65) Prior Publication Data

US 2018/0258754 A1 Sep. 13, 2018

(51) Int. Cl.
*G01V 1/40* (2006.01)
*E21B 47/022* (2012.01)
(Continued)

(52) U.S. Cl.
CPC ..... *E21B 47/02216* (2013.01); *E21B 47/082* (2013.01); *E21B 47/0905* (2013.01); *E21B 43/2406* (2013.01)

(58) Field of Classification Search
CPC ..... E21B 47/082
(Continued)

(56) References Cited

U.S. PATENT DOCUMENTS 5,305,212 A 4/1994 Kuckes
10,267,944 B2 * 4/2019 San Martin ..... G01V 3/34
(Continued)

FOREIGN PATENT DOCUMENTS

WO 2012/125369 A2 9/2012
WO 2016/007893 A1 1/2016

OTHER PUBLICATIONS

International Search Report and Written Opinion issued in related PCT Application No. PCT/US2016/054042 dated May 10, 2017, 11 pages.

(Continued)

*Primary Examiner* — Toan M Le
*Assistant Examiner* — Xiuqin Sun
(74) *Attorney, Agent, or Firm* — Jason Sedano; Baker Botts L.L.P.

(57) ABSTRACT

Planning and real time optimization of one or more modules of a downhole tool provide efficient and cost-effective deployment of a measurement system, for example, for a ranging tool. Considerations of the environment and type of operation may be considered prior to the deployment of a downhole tool such that the downhole tool comprises modules that may be optimized. Certain modules may be activated for specific operations without having to extract the downhole tool as all modules necessary to perform the specific tasks for a given operation are included prior to deployment of the downhole tool. The one or more modules may be optimized in real time based, for example, on received measurements or previous survey results. The modularity of the downhole tool allows for flexibility in fine tuning the tool according to a varying formation environment and other parameters.

30 Claims, 6 Drawing Sheets

(51) Int. Cl.
*E21B 47/09* (2012.01)
*E21B 47/08* (2012.01)
*E21B 43/24* (2006.01)

(58) Field of Classification Search
USPC ..... 702/6
See application file for complete search history.

(56) References Cited

U.S. PATENT DOCUMENTS

| | | | | |
|---|---|---|---|---|
| 2014/0191879 | A1 | 7/2014 | Bittar et al. | |
| 2015/0167440 | A1 | 6/2015 | Kasevich et al. | |
| 2015/0268371 | A1* | 9/2015 | Donderici ..... | E21B 47/02216 324/346 |
| 2015/0354336 | A1 | 12/2015 | Maurice et al. | |
| 2016/0258276 | A1* | 9/2016 | Donderici ..... | E21B 47/02216 |

OTHER PUBLICATIONS

Bittar, Michael S., Hsu-Hsiang Wu, and Shanjun Li. "New Logging While Drilling Ranging Technique for SAGD: Theory and Experiment." SPE Annual Technical Conference and Exhibition. Society of Petroleum Engineers, 2012.

Kuckes, Arthur F., et al. "An electromagnetic survey method for directionally drilling a relief well into a blown out oil or gas well." Society of Petroleum Engineers Journal 24.03 (1984): 269-274.

* cited by examiner

PLANNING AND REAL TIME OPTIMIZATION OF ELECTRODE TRANSMITTER EXCITATION

CROSS-REFERENCE TO RELATED APPLICATION

The present application is a U.S. National Stage Application of International Application No. PCT/US2016/054042 filed Sep. 28, 2016, which is incorporated herein by reference in its entirety for all purposes.

BACKGROUND

The present disclosure relates generally to well drilling operations and, more particularly, to planning and real time optimization of electrode transmitter excitation.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Ranging tools are used to determine the position, direction and orientation of a conductive pipe (for example, a metallic casing) for a variety of applications. In certain instances, such as in a blowout, it may be necessary to intersect a first well, called a target well, with a second well, called a relief well. The second well may be drilled for the purpose of intersecting the target well, for example, to relieve pressure from the blowout well. In certain instances, such as a crowded oil field, it may be necessary to identify the location of multiple wells to avoid collision incidents. In certain instances, a ranging tool is used to drill a parallel well to an existing well, for example, in steam assist gravity drainage (SAGD) well structures. In certain instances, a ranging tool is used to track an underground drilling path using a current injected metallic pipe over the ground as a reference. Determining the position and direction of a conductive pipe (such as a metallic casing) accurately and efficiently is required in a variety of applications, including downhole ranging applications. The planning and real time optimization of electrode transmitter excitation increases accuracy, and decreases costs of the operation.

FIGURES

Some specific exemplary embodiments of the disclosure may be understood by referring, in part, to the following description and the accompanying drawings.

Figure 1:
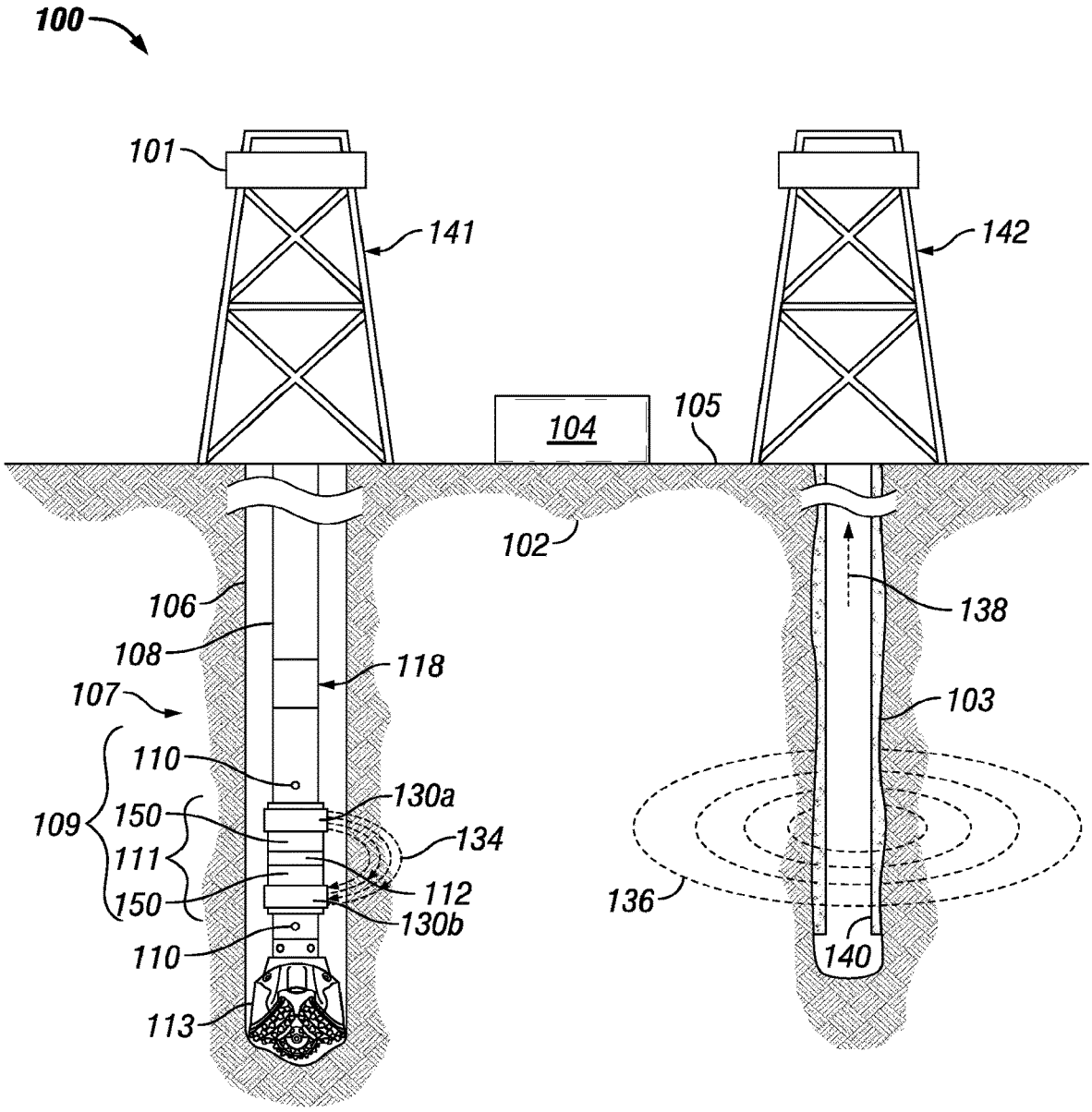
FIG. 1 is a diagram illustrating an example application, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to planning and real time optimization of electrode transmitter excitation.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1a" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or local area network (LAN). Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

Modern petroleum drilling and production operations demand information relating to parameters and conditions downhole. Several methods exist for downhole information collection, including logging while drilling ("LWD") and measurement—while drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

There exist different approaches for obtaining current on the target pipe to perform ranging operations and for taking ranging measurements. In one approach, an electrode type transmitter is used to induce current on the target pipe. This current then induces a secondary magnetic field which can be measured by the receivers on the ranging tool. Based on the strength of the magnetic field, location of the target well may be determined, for example. Alternatively, gradient of the magnetic field radiated by the target pipe in addition to the magnetic field itself may also be measured. By using a relationship between the magnetic field and its gradient, a ranging measurement may be made.

A planning tool or a planning application provides an optimal design for a given ranging tool based, at least in part, on the particular operation, including, but not limited to, drilling operation. A real time optimization component provides selection of an optimal component for the ranging tool based, at least in part, on the properties of the specific environment associated with the drilling operation. In this way, a ranging tool may be optimized efficiently and inexpensively for a given operation and environment. A proposed modular design allows any number of other tools to be located between the components of a ranging tool to increase the compactness of the entire assembly. For example, a general limit on the design parameters of a downhole tool may be defined for a given range of operating conditions of the downhole tool. Improved range and accuracy of the downhole tool may be achieved by manipulating the properties of the downhole tool within the general limits through planning or real time optimization.

FIG. 1 is a diagram illustrating an example drilling and ranging system environment 100, according to aspects of the present disclosure. The environment 100 includes rig 101 at the surface 105 and positioned above borehole 106 within a subterranean formation 102. Rig 101 may be coupled to a drilling assembly 107, comprising drill string 108 and bottom hole assembly (BHA) 109. The BHA 109 may comprise a drill bit 113 and a downhole tool 111. The downhole tool 111 may be any type of downhole tool 111 including, but not limited to, a MWD, an LWD, ranging tool, sensors, a galvanic tool, etc. In certain embodiments, the drilling assembly 107 may be rotated by a top drive mechanism (not shown) to rotate the drill bit 113 and extend the borehole 106. In certain other embodiments, a downhole motor (not shown), such as a mud motor, may be included to rotate the drill bit 113 and extend the borehole 106 without rotating the drilling assembly 107. In other embodiments, such as in an offshore drilling operation, the surface 105 may be separated from the rig 101 by a volume of water.

As used herein, a galvanic tool may comprise any tool with electrodes through which current is injected into a subterranean formation and a voltage response of the formation to the injected current is measured. As the drill bit 113 extends the borehole 106 through the formation 102, the downhole tool 111 may collect resistivity measurements relating to borehole 106, the borehole 103 and the formation 102. In certain embodiments, the orientation and position of the downhole tool 111 may be tracked using, for example, an azimuthal orientation indicator, which may include magnetometers, inclinometers, and/or accelerometers, though other sensor types such as gyroscopes may be used in some embodiments.

Ranging operations may require that a location of a target object, for example, a conductive target, be identified. In the embodiment shown, the target object comprises a target well 142 for a second borehole 103. The borehole 103 may comprise a casing 140 containing or composed of an electrically conductive member such as casing, liner or a drill string or any portion thereof that has had a blowout or that needs to be intersected, followed, tracked or avoided. In the embodiment shown, the borehole 103 includes an electrically conductive casing 140. Identifying the location of the target well 142, with respect to the drilling well 141, with conductive casing 140 may comprise taking various measurements and determining a direction of the target well 142 and borehole 103 relative to the borehole 106. These measurements may comprise measurements of electromagnetic fields in the formation using the electrodes 130. Magnetic field measurements may identify the distance, orientation and direction to the target well 142.

In certain embodiments, performing ranging measurements may include inducing an electromagnetic (EM) field within the second borehole 103 based, at least in part, on a formation current 134 injected into the formation 102. In the embodiment shown, inducing a magnetic field within the borehole comprises injecting a formation current 134 into the formation 102 by exciting a transmit electrode 130*a* and returning at return electrode 130*b* where the electrodes 130 are coupled to the downhole tool 111. The source of the excitation may be a voltage or a current. Electrodes 130 may be components of the downhole tool 111, BHA 109, or any other downhole component. Part of the induced formation current 134 may be received and concentrated at the casing 140 within the target well 142, shown as current 138, and the current 138 on the casing 140 may induce a magnetic field 136 in an azimuthal direction from the direction of the flow of the electric current 138. Formation current 134 may be induced within the formation 102 by energizing the transmit electrode 130*a* of the drilling assembly 107 according to a control signal that specifies signal characteristics for the formation current 134. The formation current 134 may comprise, for example, an alternating current electrical signal. The transmit electrode 130*a* may be a solenoid electrode or any other type of suitable electrode. Part of the induced formation current 134 may be received and concentrated at the casing 140 within the target well 142, shown as current 138, and the current 138 on the casing 140 may induce a magnetic field 136 in an azimuth direction from the direction of the flow of the electric current 138. A magnetic field 136 created by the target object, for example, casing 140 of target well 142, may be proportional to the current flowing into the formation 102.

In particular, the drilling assembly 107 includes a gap sub 112 that may allow for the creation of a dipole electric field to be created across the gap sub 112 to aid in flowing current into the formation 102. Formation current 134 may be induced within the formation 102 by energizing a transmit electrode 130*a* of the drilling assembly 107 according to a control signal that excites the transmit electrode 130*a* which induces or injects a formation current 134 into the formation 102. It is noted here that the gap sub 112 is used to prevent the formation current 134 from flowing through the downhole tool 111 and to direct the transmit electrode 130*a* to the return electrode 130*b*. However, in one or more embodiments the gap sub 112 may not be required. For example, if the transmit electrode 130*a* is located far enough away from the return electrode 130*b* and the electrodes 130 are sufficiently isolated from the BHA 109 or are electrically isolated from the downhole tool 111. Electrodes 130 may be positioned at various locations along the downhole tool 111 or BHA 109.

In certain embodiments, a system control unit 104 may be positioned at the surface 105 as depicted in FIG. 1 and may be communicably or communicatively coupled to downhole elements including, but not limited to, drilling assembly 107, telemetry system 118, downhole tool 111, and BHA 109. In other embodiments, a system control unit 104 may be positioned below the surface 105 (not shown) and may communicate data to another system control unit 104 or any other system capable of receiving data from the system control unit 104. For example, the control unit 104 may be communicably coupled to the downhole tool 111, electrodes 130, drill bit 113, or any other component through a telemetry system 118. The telemetry system 118 may be incorporated into the BHA 109 or any other downhole component of drilling assembly 107 and may comprise a mud pulse type telemetry system that transmits information between the surface system control unit 104 and downhole elements via pressure pulses in drilling mud. Although the system control unit 104 is positioned at the surface 105 in FIG. 1, certain processing, memory, and control elements may be positioned within the drilling assembly 107. Additionally, various other communication schemes may be used to transmit communications to/from the system control unit 104, including wireline configurations and wireless configurations.

In certain embodiments, the system control unit 104 may comprise an information handling system with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

The formation current 134 may be injected into the formation 102 by excitation of the transmit electrode 130*a*. In certain embodiments, the system control unit 104 may excite the transmit electrode 130*a* by sending a command downhole to the downhole tool 111 or a controller associated with the downhole tool 111. The command(s) may cause the downhole tool 111 to excite the transmit electrode 130*a*. In other embodiments, the transmit electrode 130*a* is excited by a downhole source located at or associated with the downhole tool 111. In one or more embodiments the source of excitation may be located downhole or at the surface 105.

In certain embodiments, the signal characteristics of the formation current 134 may be based at least in part on at least one downhole characteristics within the borehole 106 and formation 102, including a noise level within the formation 102; a frequency transfer function of the transmit electrode 130*a*, the return electrode 130*b*, and the formation 102; and a frequency response of the target object. The noise level within the formation 102 may be measured downhole using electromagnetic or acoustic receivers coupled to the drilling assembly, for example. The frequency transfer function and the frequency response of the target borehole 103 may be determined based on various mathematical models, or may be extrapolated from previous ranging measurements. In certain embodiments, the system control unit 104 may further send commands to any one or more receivers 110 to cause any of the any one or more receivers 110 to measure the induced magnetic field 136 on the second borehole 103. Like the transmit electrode 130*a*, any of the one or more receivers 110 may be coupled to a downhole controller, and the commands from the system control unit 104 may control, for example, when the measurements are taken. In certain embodiments, the system control unit 104 may determine and set a sampling rate of the induced magnetic field 136, as will be described below. Additionally, measurements taken by any of the one or more receivers 110 may be transmitted to the system control unit 104 via the telemetry system 118. The control unit 104 may determine a distance, orientation and direction to the conductive target (for example, target well 142 or casing 140 of borehole 103) in the embodiment shown, based at least in part on the measurement of the induced magnetic field 136. For example, the system control unit 104 may use geometric algorithms to determine the distance, orientation and direction of the second borehole 103 relative to the borehole 106.

In certain embodiments, the system control unit 104 may further send commands to any of the one or more receivers 110 to cause any of the one or more receivers 110 to measure the induced magnetic field 136 on the second borehole 103. Like the transmit electrode 130*a*, the return electrode 130*b* may be coupled to a downhole controller, and the commands from the system control unit 104 may control, for example, when the measurements are taken. In certain embodiments, the system control unit 104 may determine and set a sampling rate of the induced magnetic field 136, as will be described below. Additionally, measurements taken by any of the one or more receivers 110 may be transmitted to the system control unit 104 via the telemetry system 118. The control unit 104 may determine a distance, orientation and direction to the target object (for example, target well 142 or borehole 103) in the embodiment shown, based at least in part on the measurement of the induced magnetic field 136. For example, the system control unit 104 may use geometric algorithms to determine the distance, orientation and direction of the second borehole 103 relative to the borehole 106.

Figure 2:
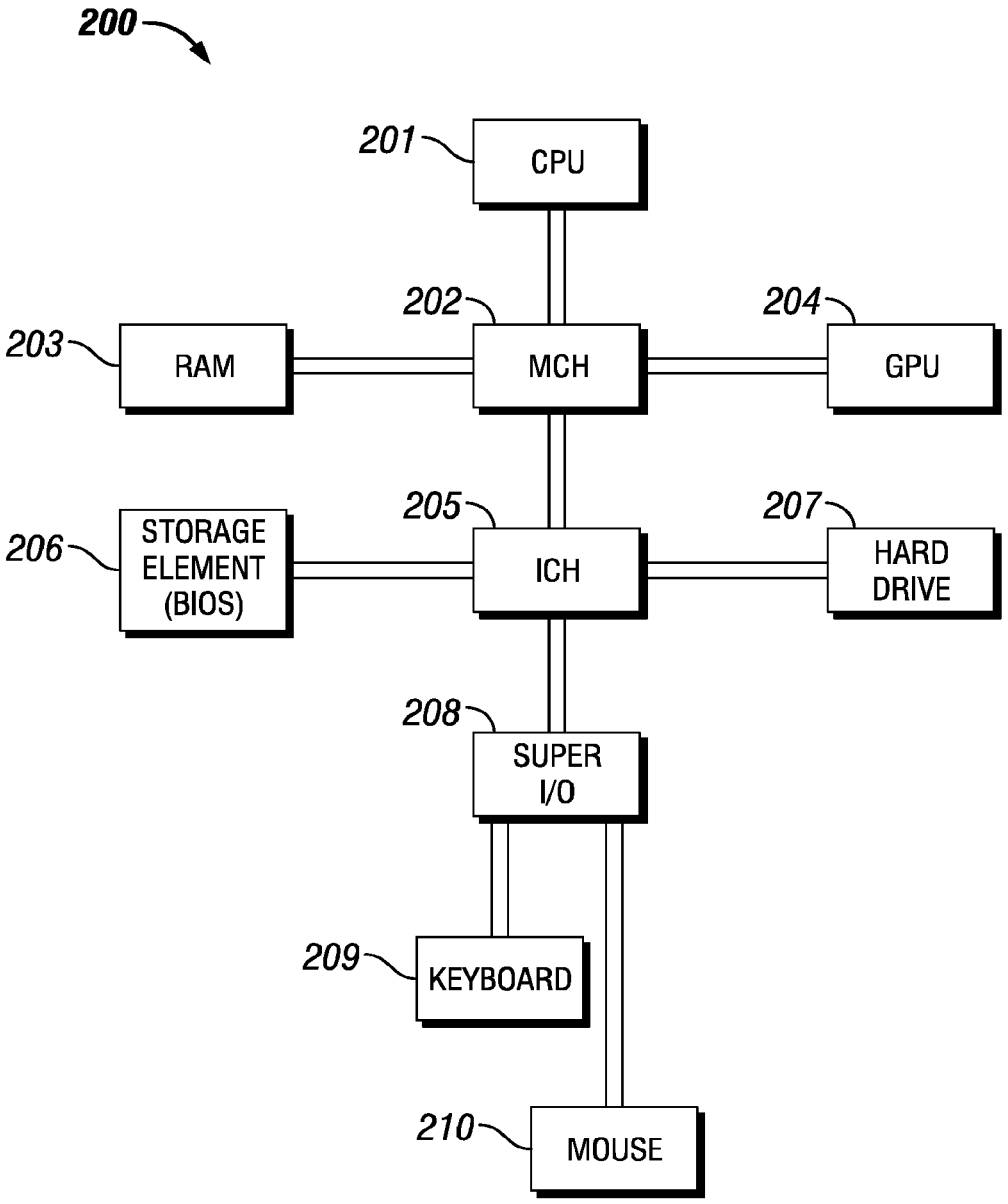
FIG. 2 is a diagram illustrating an example information handling system, according to aspects of the present disclosure.

FIG. 2 is a diagram illustrating an example information handling system 200, according to aspects of the present disclosure. The system control unit 104 may take a form similar to the information handling system 200. A processor or central processing unit (CPU) 201 of the information handling system 200 is communicatively coupled to a memory controller hub or north bridge 202. The processor 201 may include, for example a microprocessor, microcontroller, digital signal processor (DSP), application specific integrated circuit (ASIC), or any other digital or analog circuitry configured to interpret and/or execute program instructions and/or process data. Processor 201 may be configured to interpret and/or execute program instructions or other data retrieved and stored in any memory such as memory 203 or hard drive 207. Program instructions or other data may constitute portions of a software or application for carrying out one or more methods described herein. Memory 203 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from a software or application may be retrieved and stored in memory 203 for execution by processor 201.

Modifications, additions, or omissions may be made to FIG. 2 without departing from the scope of the present disclosure. For example, FIG. 2 shows a particular configuration of components of information handling system 200. However, any suitable configurations of components may be used. For example, components of information handling system 200 may be implemented either as physical or logical components. Furthermore, in some embodiments, functionality associated with components of information handling system 200 may be implemented in special purpose circuits or components. In other embodiments, functionality associated with components of information handling system 200 may be implemented in configurable general purpose circuit or components. For example, components of information handling system 200 may be implemented by configured computer program instructions.

Memory controller hub 202 may include a memory controller for directing information to or from various system memory components within the information handling system 200, such as memory 203, storage element 206, and hard drive 207. The memory controller hub 202 may be coupled to memory 203 and a graphics processing unit 204. Memory controller hub 202 may also be coupled to an I/O controller hub or south bridge 205. I/O hub 205 is coupled to storage elements of the information handling system 200, including a storage element 206, which may comprise a flash ROM that includes a basic input/output system (BIOS) of the computer system. I/O hub 205 is also coupled to the hard drive 207 of the information handling system 200. I/O hub 205 may also be coupled to a Super I/O chip 208, which is itself coupled to several of the I/O ports of the computer system, including keyboard 209 and mouse 210.

In certain embodiments, determining the distance and direction of the second borehole 103 relative to the first borehole 106 may be accomplished using the magnetic fields received by any of the one or more receivers 110. In certain embodiments, the distance and direction determination may be achieved utilizing the relationship in Equation (1) between the pipe current and the received magnetic fields.

$$\overline{H} = \frac{I}{2\pi r}\hat{\phi} \qquad \text{Equation (1)}$$

where H is the magnetic field vector, I is the current on the pipe 140, r is the shortest distance between any of the one or more receivers 110 and the casing 140; and $\phi$ is a unit vector in the azimuthal direction with respect to a cylindrical coordinate system whose axis lie along the target, for example a target well 142. Although Equation (1) assumes constant casing current along the casing, it can be extended to any current distribution by using the appropriate model.

In certain embodiments, the distance and direction of the second borehole 103 relative to the first borehole 106 may be determined using Equations (2) and (3), respectively.

$$r = \frac{I}{2\pi|\overline{H}|} \quad \text{Equation (2)}$$

$$\Phi = \text{angle}(\hat{x}\cdot\overline{H}, \hat{y}\cdot\overline{H}) + 90 \quad \text{Equation (3)}$$

where "·" is the vector inner-product operation. In certain instances, however, Equation (2) may be unreliable if a direct or accurate measurement of I is not possible.

When a direct or accurate measurement of I is difficult or impossible, magnetic field gradient measurement may be utilized for the direction and distance determinations. Spatial change in the magnetic field may be measured in a direction that has a substantial component in the radial (r-axis) direction as in Equation (4).

$$\frac{\partial\overline{H}}{\partial r} = -\frac{I}{2\pi r^2}\hat{\phi} \quad \text{Equation (4)}$$

where ∂ is the partial derivative. With this gradient measurement available in addition to an absolute measurement, the distance to the second borehole 103 may be calculated using Equation (5).

$$r = \frac{|H|}{\left|\frac{\partial\overline{H}}{\partial r}\right|} \quad \text{Equation (5)}$$

Figure 3:
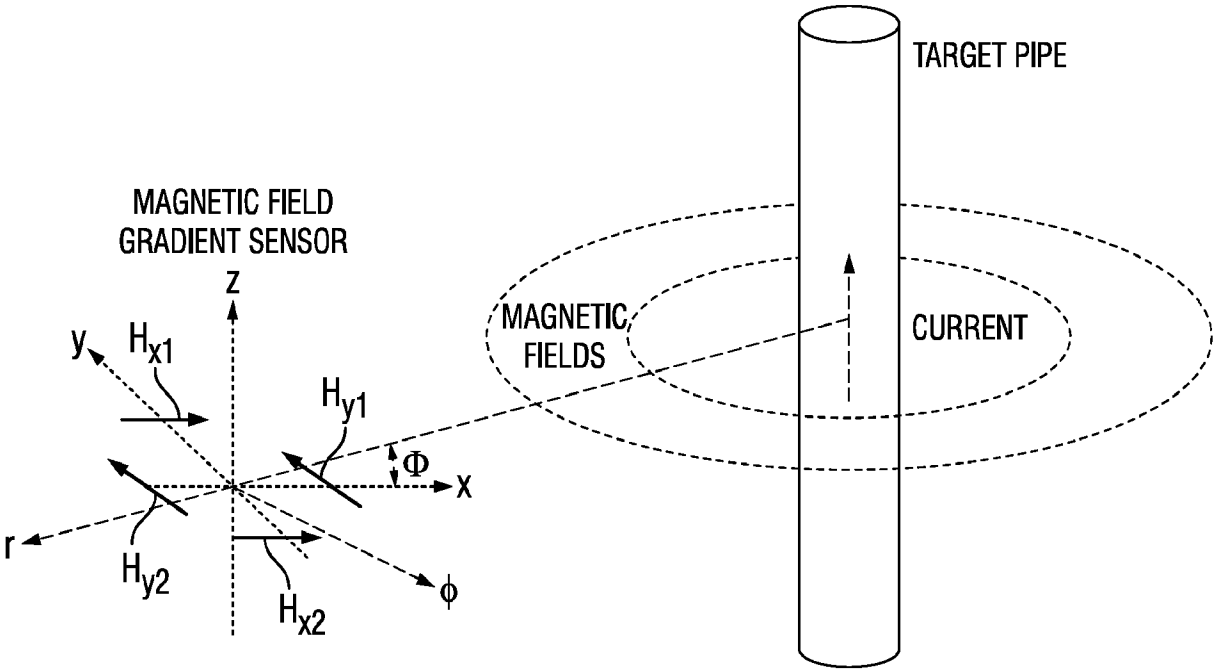
FIG. 3 is a diagram illustrating example gradient measurement components in relation to a target pipe and the magnetic fields produced by currents on the pipe.

In certain embodiments, the gradient field in Equation (5) may be realized in practice by utilizing finite difference of two magnetic field dipole measurements as shown below in Equation (6):

$$r = \frac{H_y}{\frac{H_y\left(x+\frac{\Delta x}{2}, y\right) - H_y\left(x-\frac{\Delta x}{2}, y\right)}{\Delta x}} \quad \text{Equation (6)}$$

where $H_y$ and the gradient measurement components are illustrated in the 4-dipole configuration of FIG. 3 in relation to a target, for example, casing 140, and the magnetic fields produced by currents on the casing 140.

Figure 4:
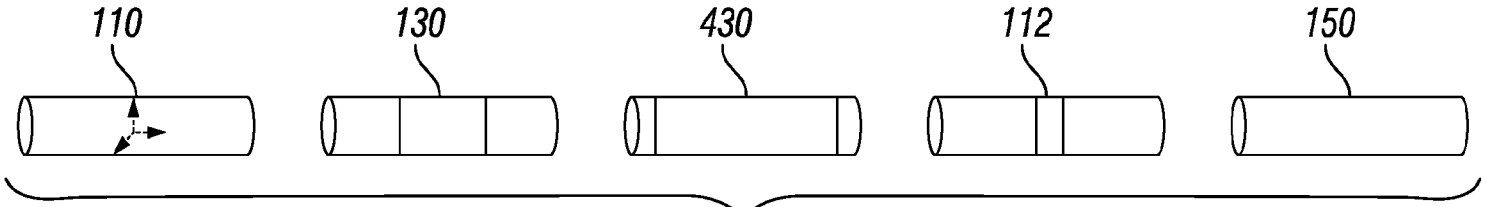
FIG. 4 is a diagram illustrating example modular components of a ranging system, according to aspects of the present disclosure.

FIG. 4 is a diagram illustrating example components for a ranging system according to one or more embodiments of the present disclosure. In one or more embodiments of the present disclosure, one or more modular components may be used to construct a downhole tool 111. A planning application utilizes the associated properties of the modular components to design a downhole tool that is optimized for a particular operation. As illustrated in FIG. 4, modular components may comprise a receiver 110, a gap sub 112, a tool module 430, an electrode 130, and a spacer module 150. Each of the modular components may be located at any location of the downhole tool 111 and in any order. The tool module 430 may comprise any tool used in downhole operations. For example, in one or more embodiments, other tools in the BHA 109 may be placed between the modules of the ranging tool 111 to provide a more compact BHA 109 design. The receiver 110 may be a module that comprises a multiaxial receiver, a magnetometer receiver, a coil type receiver or any other receivers known to one of ordinary skill in the art. For example, in one embodiment, a multiaxial receiver 110 is used to obtain directional sensitivity at an arbitrary angle. In particular embodiments, a receiver 110 measures amplitude or phase of a received signal while in alternative embodiments both may be measured. In other embodiments, a ratio of the signals at the receivers 110 may be measured and used in a determination of the range of a target object including, but not limited to, target well 142. The spacer module 150 may be located so as to increase the distance between the electrodes 130 and receivers 110. Tool module 430 may comprise a formation resistivity tool, a logging tool, a telemetry system, gamma ray tool, nuclear magnetic resonance (NMR) tool, caliper tool, mud resistivity tool or any other downhole tool required for a given operation.

Figure 5A:
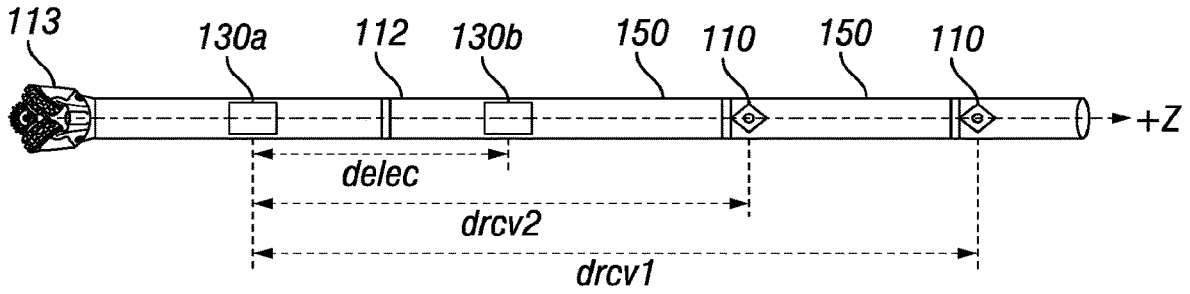
FIGS. 5A, 5B and 5C are diagrams illustrating an example configuration of modular components, according to aspects of the present disclosure.
Figure 5B:
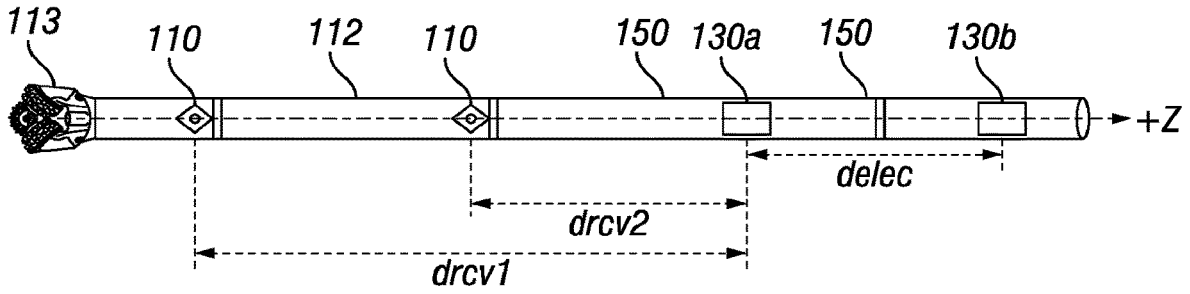
Figure 5C:
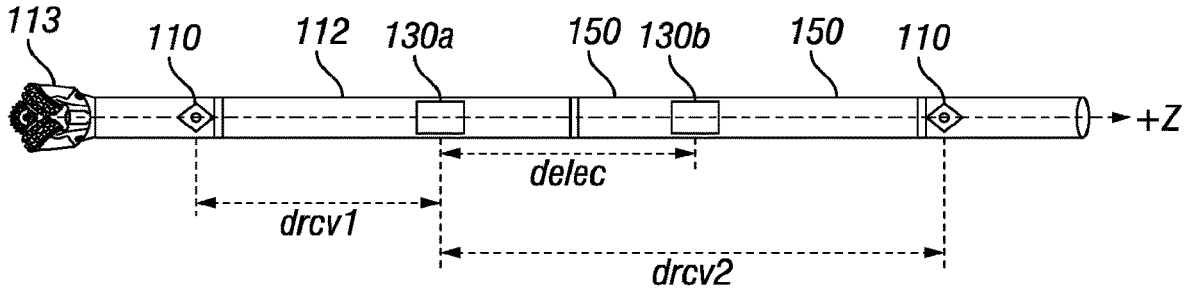

FIGS. 5A, 5B and 5C are diagrams illustrating an example configuration of modular components, according to aspects of the present disclosure. FIGS. 5A, 5B and 5C represent general embodiments of a downhole tool 111 that may be optimized through planning and real time optimization. FIG. 5A illustrates electrodes 130 close to the drill bit 113. FIG. 5B illustrates receivers 110 close to the drill bit 113. FIG. 5C illustrates receivers 110 on both sides of electrodes 130. The distance from the transmit electrode 130*a* to the first receiver 110 is denoted as "drcv1". The distance between the transmit electrode 130*a* and the second receiver 110 is denoted as "drcv2". The distance between the electrodes 130 is denoted as "delec". General limits on the spacings of the modular components of FIGS. 5A-5C are based on the range of expected operating conditions of a defined ranging tool as summarized in Table 1.

TABLE 1

| | delec | drcv1 | drcv2 |
|---|---|---|---|
| Electrodes 130 closer to drill bit 113 | ~26-32 feet<br>~7.9-9.8 meters | ~80-100 feet<br>~24.4-30.5 meters | ~53-68 feet<br>~16.2-20.7 meters |
| Receivers 110 closer to drill bit 113 | ~26-32 feet<br>~7.9-9.8 meters | ~55-75 feet<br>~16.8-22.9 meters | ~28-38 feet<br>~8.5-11.6 |
| Receivers 110 on both sides of electrodes 130 | ~13-19 feet<br>~4-5.8 meters | ~30-50 feet<br>~9.1-15.2 meters | ~30-50 feet<br>~9.1-15.2 meters |

For each, the distance between the transmit electrode 130*a* and the drill bit 113 was at least ten meters. In certain operations, it may be possible to locate receivers 110 or electrodes 130 below the drill motor closer to the drill bit 113. However, such a configuration may not improve ranging performance of the downhole tool 111. Frequency was assumed to be lower than 100 kilo Hertz (kHz) in deriving the values of Table 1 since at higher frequencies skin effect becomes dominant. At frequencies over 1 kHz, coil type receivers may be used while at frequencies below 1 kHz, magnetometer type receivers may be utilized. The limits of Table 1 are illustrative and other limits may be derived according to other parameters and conditions. With respect to the limits of Table 1, mud may be either oil or water based and formation resistivities may range from 0.1 Ω-meter to 1000 Ω-meter. While the values of Table 1 represent a general limit, an optimization may be performed within the planning stage or in real time according to a specific operation.

In one or more embodiments, a planner application may allow the specifications (for example, number of spacing modules 150, location and number of gap subs 112 and frequency) of a downhole tool 111 to be altered before a measurement run based, at least in part, on information about the drilling environment, resistivity of the mud, caliper size of the operation, or any other factors. A modular design yields efficient and cost-effective downhole tools 111 as any changes required may be implemented quickly and easily. For example, an optimization may be performed onsite using a forward model of the response of downhole tool 111. For example, system control unit 104 or any other information handling system 200 may be utilized to determine the forward model, execute the planner application, execute the real time optimization or to provide any other functionality necessary to optimize the configuration. The forward model may comprise a precomputed table. The response of different configurations used in different embodiments may be determined based, at least in part, on one or more performance criteria. For example, the one or more performance criteria may comprise signal level at any one or more of the receivers 110, signal difference between any one or more of the receivers 110, power consumption of the downhole tool 111, power consumption of any component of the downhole tool 111 such as receivers 110, spacing modules 150, transmit electrode 130*a*, return electrode 130*b*, ranging accuracy of the downhole tool 111 such as percentage error in distance calculation, degree error in relative azimuth angle to target calculation, degree error in relative elevation angle to target calculation, any other criteria known to one of ordinary skill in the art, or any combination thereof. In one or more embodiments, only one criteria is considered, for example, only the ranging accuracy may be considered. In one or more embodiments, one or more performance criteria along with other design elements may be considered, for example, the dog-leg of the resulting configuration together with the ranging accuracy may be utilized to determine if a collision may be avoided in time. In one or more embodiments, the optimized configuration may satisfy all the performance criteria. In other embodiments, trade-offs occur such that not all performance criteria may be satisfied. In one or more embodiments, weights are associated with one or more performance criteria and these weights along with one or more factors or conditions may be utilized to determine the optimized configuration.

Figure 6:
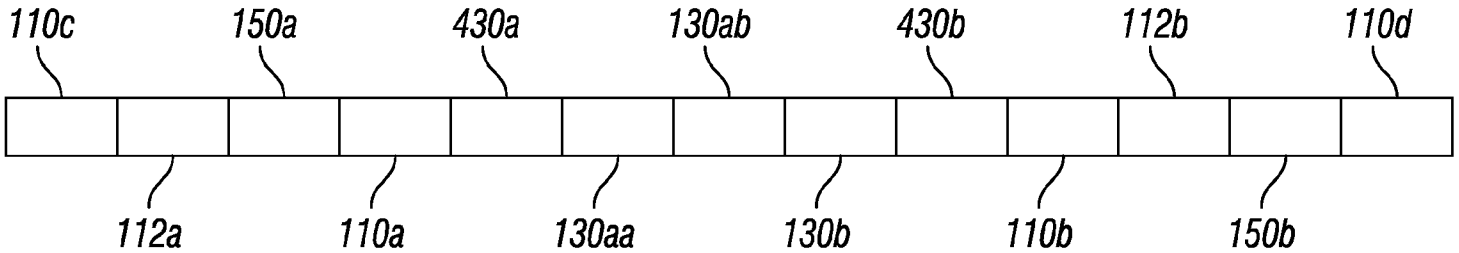
FIG. 6 is a diagram illustrating an example modular design of components of a ranging system, according to aspects of the present disclosure.

In one or more embodiments, an optimized configuration may combine characteristics of multiple designs. For example, FIG. 6 is a diagram illustrating an example modular design of components of a ranging system, according to aspects of the present disclosure. FIG. 6 illustrates a downhole tool 111 that may be optimized in real time. The downhole tool of FIG. 6 comprises two transmit electrodes 130*aa* and 130*ab* as modules connected to a return electrode 130*b*. The first transmit electrode 130*aa* is coupled to a logging tool 430*a* and to a second transmit electrode 130*ab*. Logging tool 430*a* is coupled to a gap sub 112*a*. Gap sub 112*a* is coupled to a receiver 110*a* which is coupled to a spacer module 150*a*. Spacer module 150*a* is coupled is coupled to another receiver 110*c*. Return electrode 130*b* is coupled to the second transmit electrode 130*ab* and a resistivity tool 430*b*. Resistivity tool 430*b* is coupled to a gap sub 112*b* which is coupled to a receiver 110*b*. Receiver 110*b* is coupled to a spacer module 150*b* which is coupled to a gap sub 112*d*. Gap sub 112*d* is coupled to another receiver 110*d*. Two transmit electrodes 130*a* (transmit electrodes 130*aa* and 130*ab*) are utilized to account for difference in delec ranges as illustrated in Table 1. In general, the more modules comprising receivers 110 and electrodes 130 the greater the flexibility in real time optimization. In any embodiment, a transmit electrode 130*a*, return electrode 130*b* and a receiver 110 may be selected based on a sensitivity parameter.

Figure 7:
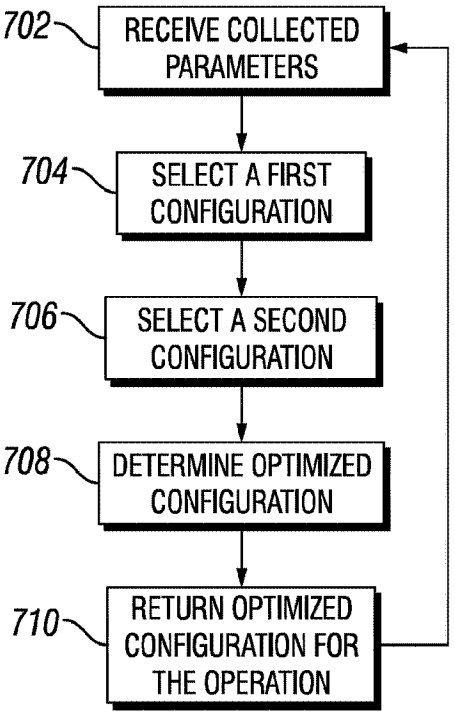
FIG. 7 is a flowchart for a method to optimize a modular design of components of a ranging system, according to aspects of the present disclosure.

FIG. 7 is a flowchart for a method to optimize a modular design of components of a ranging system, according to aspects of the present disclosure. At step 702, one or more collected parameters are received, for example, by the planner application. For example, the planner application may request results from stored test cases based on the predicted operating conditions for a particular operation. For example, a priori surveys obtained using other tools may be stored and later used by the planner application as the collected parameters. For example, in one or more embodiments a downhole measurement is received using a particular configuration for a given operation. Based, at least in part, on this downhole measurement, a distance, direction, orientation or any combination thereof to a target object may be determined. For a given operation, a drilling parameter may be adjusted based, at least in part, on the determined distance, direction and/or orientation of the target object. The one or more collected parameters may comprise one or more ranging parameters, a frequency of a signal, a power level, a current level, a formation resistivity, a mud resistivity, a borehole diameter, or any other parameter known to one of ordinary skill in the art.

At step 704, a first configuration is determined by selecting one or more modules. The first configuration may be based, at least in part, on at least one of the one or more collected parameters. The one or more modules may be modules including, but not limited to, a transmit electrode 130*a* (transmit module), a return electrode 130*b* (return module), a receiver 110 (receiver module), a space module, a gap sub 112 (gap sub module), a tool module. Selecting the first configuration may comprise determining if selected modules perform within the range given by the one or more collected parameters or a priori surveys such as the ranges of Table 1. A determination may also be made to verify that the first configuration satisfies the dog-leg requirements for a given scenario or environment.

At step 706, a second configuration is determined by selecting one or more modules similar to step 704. At step 708, the optimized configuration is determined from at least the first configuration and the second configuration. For example, the responses from the determination of whether each configuration satisfies the dog-leg requirements may be determined. These responses may be compared based on one or more performance criteria. For example, it may be determined if the signal levels of each configuration are greater than the noise floor expected, whether signal difference between receiver modules above a threshold and power consumption are under a limit provided, or any other one or more performance criteria. For example, in one embodiment, a configuration is not selected or is discarded if a simulated signal from a target object is lower than that of a noise level of a given configuration as any measurement received using the given configuration would not be reliable or have a high degree of accuracy as the signal would not be discernable from the noise. Alternatively, a configuration may be discarded if the average signal to noise ratio of a signal associated with a particular configuration is lower than the average signal to noise ratio of a different configuration. The ranging accuracy of each configuration may also be determined to see if it is within accuracy limits for the ranges of distance and orientation required. For example, test cases representative of the properties of the environment may be used to determine if a configuration is within accuracy limits. For example, an inversion may be used to determine ranging accuracy. A Monte Carlo type simulation may also be run by injecting noise to simulated measurements and the results may be inverted to determine the expected error in range for any accuracy test case.

At step 710, the determined optimized configuration is returned by the planner application. The method continues to select configurations for each operation of the downhole tool 111 required for a particular environment. While the method describes a first configuration and a second configuration, the present disclosure contemplates that any number of configurations may be selected for a given operation to determine which configuration should be the optimized configuration for the operation.

Figure 8:
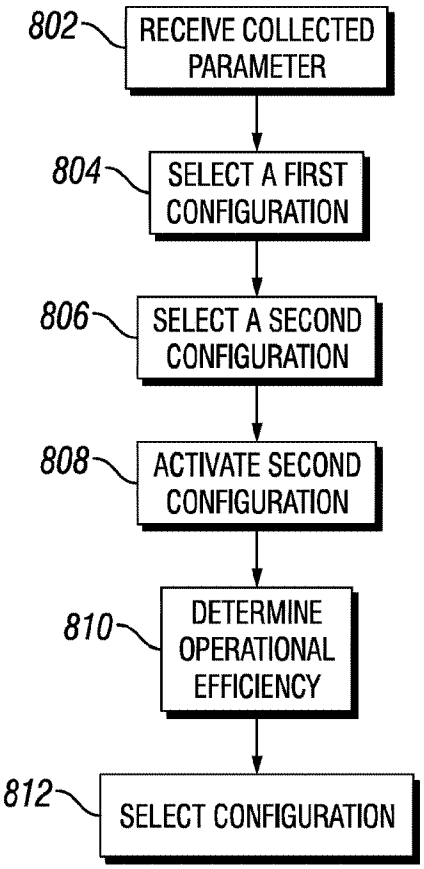
FIG. 8 is a flowchart for a method for an optimized modular design of a downhole tool, according to aspects of the present disclosure.

FIG. 8 is a flowchart for a method for an optimized modular design of a downhole tool, according to aspects of the present disclosure. At step 802, one or more collected parameters are received, for example, by the planner application. At step 804, at least one of one or more modules for a first configuration are selected based, at least in part, on at least one of the one or more collected parameters. In one or more embodiments, the at least one of the one or more modules of the first configuration are activated and a first measurement associated with the at least one of the one or more modules of the first configuration is received. At step 806, at least one of one or more modules for a second configuration are selected based, at least in part, on at least one of the one or more collected parameters. At step 808, in one or more embodiments, the at least one of the one or more modules of the second configuration are activated and a second measurement associated with the at least one of the one or more modules of the second configuration is received. Each selected configuration may be implemented in a downhole tool 111 such that a signal may be sent to the downhole tool 111 to activate a particular configuration. For example, a configuration may comprise multiple transmit electrodes 130*a* as illustrated in FIG. 6. A first configuration may comprise exciting transmit electrode 130*aa* while a second configuration may comprise exciting transmit electrode 130*ab*.

At step 810, the operational efficiency of the activated second configuration may be determined. In one or more embodiments, the operational efficiency of the first configuration may also be determined either from previous results or from activating the first configuration. At step 812, a configuration is selected based on the determined operational efficiency of each configuration. For example, in one or more embodiments, the operational efficiency of the first configuration and the second configuration may be analyzed or compared to determine which configuration meets the requirements for a given operation, criteria, scenario or environment. In other embodiments, the operational efficiency for any number of configurations may be compared so as to select a suitable configuration for a third operation. The analysis of the operational efficiency may be based, at least in part, on the one or more collected parameters, one or more electromagnetic simulations, one or more operational constraints (such as drilling rate, bending radius, bottom hole assembly length, total power consumption associated with each configuration, or any other operational constraints). In one or more embodiments, the at least one or more modules associated with the selected configuration (at least one of the first configuration or the second configuration) is activated and a third measurement may be received associated with the selected configuration. In one or more embodiments, any one or more of the measurements, the first measurement, the second measurement and the third measurement, may be used to calculate or determine a ranging parameter and a drilling parameter may be altered based, at least in part, on the determined ranging parameter.

Figure 9:
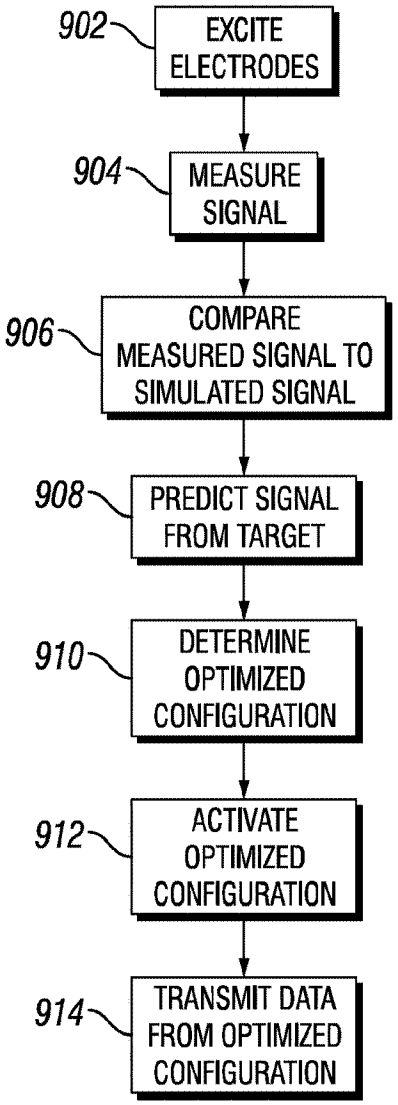
FIG. 9 is a flowchart for a method for an optimized modular design of a downhole tool, according to aspects of the present disclosure.

FIG. 9 is a flowchart for a method for an optimized modular design of a downhole tool, according to aspects of the present disclosure. A downhole tool 111 may comprise one or more modules as illustrated in FIG. 4. The one or more modules may comprise two or more transmit electrodes 130*a* and two or more receivers 110. The downhole tool 111 may be deployed as part of a drilling assembly 107 within a borehole 106 as part of drilling well 141. During drilling at drilling well 141 it may be necessary to avoid collision with a target object, such as the casing 140 (for example, conductive casing) of drilling well 142. At step 902, one or more transmit electrodes 130*a* may be excited sequentially or if the downhole tool 111 is a multi-frequency tool, multiple frequencies of a single transmit electrode 130*a* may be excited at the same time or if the transmit electrodes 130*a* have different frequencies then two or more of the transmitters 130*a* may be excited at the same time.

At step 904, a signal is measured at the receivers 110 for each transmitted signal for each frequency. The measured signal may be the absolute value or the phase of a field or both. In one or more embodiments, the measured signal may be the absolute value or the phase of a voltage or both. In one or more embodiments, the measured signal may be a complex value field value or voltage. In some embodiments, a ratio of the measured signals of different receivers 110 may be measured.

At step 906, the measured signal may be compared with a simulated signal obtained a priori. For example, the measured signal may be compared with a simulated signal obtained with a forward model of the downhole tool 111. This forward model may use auxiliary information from other components including, but not limited to, measurements from a resistivity tool, mud sensor, and a caliper sensor. At step 908, the difference between the measured signal and the forward model may be used to predict the amount of signal coming from the target object. In one or more embodiments, a weight may be associated with a measured signal where the weight is based, at least in part, on the quality of the measured signal and these weights may be used in an inversion. At step 910, the optimized configuration is determined based, at least in part, on the value of the predicted amount of signal coming from the target object.

At step 912, the optimized configuration is activated such that one or more measurements are taken by the downhole tool 111 using the optimized configuration. At step 914, one or more measurements are transmitted from the downhole tool 111 using the optimized configuration to an information handling system 200 (for example, system control unit 104). Because the modules of the downhole tool 111 have been optimized (an optimized configuration is used) poor quality information may not be used in ranging calculations as the downhole tool 111 transmits the measurements from the optimized configuration. In one or more embodiments, one or more ranging parameters are determined downhole to reduce the amount of transmission to a surface information handling system 200.

In one or more embodiments, a downhole tool 111 may be a ranging tool. A first measurement may be received by activating a selected first configuration of a ranging tool. A second measurement may be received by activating a selected second configuration of a ranging tool. One or more ranging parameters may be calculated based, at least in part, on the first measurement, the second measurement, or any combination thereof. An operational parameter may then be adjusted based, at least in part, on the calculated ranging parameter. For example, one or more of a drilling parameter, a logging parameter, a completion parameter, a production parameter, or any other parameter associated with the operation at the deployment site, such as drilling well 141. Any number of configurations may be selected and any number of measurements from any configuration may be received. In one or more embodiments, measurements received are communicated to the surface 105 to a system control unit 104 or any other information handling system 200 at the surface 105 and the one or more ranging parameters are calculated at the surface 105. In one or more embodiments, the measurements received are stored downhole and communicated to the surface 105 at timed intervals, upon request, upon expiration of a timer, at an interrupt, or at any other suitable time period whereupon the one or more ranging parameters are calculated at the surface 105. In one or more embodiments, the measurements are stored and the one or more ranging parameters are calculated downhole. The determination regarding adjusting one or more operational parameters may be determined downhole, at the surface 105 or any combination thereof.

In one or more embodiments, a planner application may determine one or more configurations of one or more modules to include in a downhole tool 111 and then once the downhole tool 111 is downhole, a real time optimization (for example, as illustrated by FIG. 9) may occur. For example, it may be determined that a formation 102 may comprise layers of high resistivity and layers of low resistivity. The planner application may determine one or more configurations for such an environment. During operation (for example, drilling), a determination may be made on the type of layer (for example, level of resistivity may be determined using a tool module 430 that comprises a resistivity tool) and an optimized configuration from the one or more configurations may be selected and activated.

In one or more embodiments, a method for downhole ranging within a formation comprises receiving one or more collected parameters, wherein the one or more collected parameters comprise one or more ranging parameters, a frequency of a signal, a power level, a voltage level, a current level, a formation resistivity, a mud resistivity, and a borehole diameter, selecting at least one of one or more modules for a first configuration of a ranging tool based, at least in part, on at least one of the one or more collected parameters, and wherein the one or more modules comprise at least one of a transmitter module, a return module, a receiver module, a spacer module, a gap sub module, and a tool module, activating at least one of the one or more modules of the first configuration of the ranging tool, receiving a first measurement associated with the first configuration of the ranging tool, selecting at least one of the one or more modules for a second configuration of the ranging tool based, at least in part, on the one or more collected parameters and one or more operational conditions, activating the at least one of the one or more modules of the second configuration of the ranging tool, receiving a second measurement associated with the second configuration of the ranging tool, calculating a ranging parameter based, at least in part, on the first measurement and the second measurement and adjusting at least one operational parameter based, at least in part, on the calculated ranging parameter. In one or more embodiments, the method further comprises comparing a simulated signal from a target to a noise level for each of the first configuration and the second configuration and discarding a configuration with a signal strength of the signal from the target lower than that of the noise level. In one or more embodiments, the method further comprises analyzing operational efficiency for each of the first configuration and the second configuration based, at least in part, on the one or more collected parameters and selecting a configuration from one of the first configuration or the second configuration based, at least in part, on the analyzed operational efficiency for each of the first configuration and the second configuration. In one or more embodiments, analyzing the operational efficiency for each of the first configuration and the second configuration comprises performing electromagnetic simulations for each of the first configuration and the second configuration. In one or more embodiments, the method further comprises collecting the at least one of the one or more collected parameters by making a downhole measurement using the selected configuration and determining at least one of a distance, a direction and an orientation to a target based, at least in part, on the downhole measurement. In one or more embodiments, the method further comprises adjusting a drilling parameter based, at least in part, on the determined at least one of the distance, the direction and the orientation to the target. In one or more embodiments, the method further comprises analyzing one or more operational constraints, wherein the one or more operational constraints comprise at least one of drilling rate, bending radius, bottom hole assembly length, total power consumption associated with each configuration, and wherein analyzing the operational efficiency for each of the first configuration and the second configuration is based, at least in part on the analyzed operational constraints. In one or more embodiments, the method further comprises selecting at least one of the transmitter module and at least one of the receiver module based, at least in part, on a sensitivity parameter for at least one of the first configuration and the second configuration. In one or more embodiments, at least one of the one or more modules of the first configuration and the second configuration comprise the tool module, wherein the tool module comprises a telemetry module. In one or more embodiments, at least one of the first configuration and the second configuration comprises the transmitter module, the receiver module, the spacer module, the gap sub module, and the tool module, wherein the tool module comprises at least one telemetry module. In one or more embodiments, at least one of the first configuration and the second configuration comprises two transmitter modules and two receiver modules, wherein the receiver modules are on either side of the transmitter modules, and wherein the two receiver modules comprise at least one of a coil or magnetometer.

In one or more embodiments, a wellbore drilling system for drilling in a subsurface earth formation comprises a ranging tool coupled to a drill string, an information handling system communicably coupled to the ranging tool, the information handling system comprises a processor and memory device coupled to the processor, the memory device containing a set of instruction that, when executed by the processor, cause the processor to receive one or more of the collected parameters, wherein the one or more collected parameters comprise one or more ranging parameters, a frequency of a signal, a power level, a current level, formation resistivity, mud resistivity, and borehole diameter, select at least one of one or more modules for a first configuration of the ranging tool based, at least in part, on at least one of the one or more collected parameters, and wherein the one or more modules comprise at least one of a transmitter module, a receiver module, a spacer module, a gap sub module, and a tool module, activate the at least one of the one or more modules of the first configuration of the ranging tool, receive a first measurement associated with the first configuration, select at least one of the one or more modules for a second configuration of the ranging tool based, at least in part, on the one or more collected parameters and one or more operational conditions, activate the at least one of the one or more modules of the second configuration of the ranging tool, receive a second measurement associated with the second configuration, calculate a ranging parameter based, at least in part, on the first measurement and the second measurement and adjust at least one operational parameter based, at least in part, on the calculated ranging parameter. In one or more embodiments, the set of instructions further cause the processor to compare a simulated signal from a target to a noise level for each of the first configuration and the second configuration and discard a configuration with a signal strength of the signal from the target lower than that of the noise level. In one or more embodiments, the set of instructions further cause the processor to analyze operational efficiency for each of the first configuration and the second configuration based, at least in part, on the one or more collected parameters and select a configuration one of the first configuration or the second configuration based, at least in part, on the analyzed operational efficiency for each of the first configuration and the second configuration. In one or more embodiments, analyzing the operational efficiency for each of the first configuration and the second configuration comprises performing electromagnetic simulations for each of the first configuration and the second configuration. In one or more embodiments, the set of instructions further cause the processor to collect the at least one of the one or more collected parameters by making a downhole measurement using the selected configuration and determine at least one of a distance, a direction and an orientation to a target based, at least in part, on the downhole measurement. In one or more embodiments, the set of instructions further cause the processor to adjust a drilling parameter based, at least in part, on the determined at least one of the distance, the direction and the orientation to the target. In one or more embodiments the set of instructions further cause the processor to analyze one or more operational constraints, wherein the one or more operational constraints comprise at least one of drilling rate, bending radius, bottom hole assembly length, total power consumption associated with each configuration, wherein analyzing the operational efficiency for each of the first configuration and the second configuration is based, at least in part on the analyzed operational constraints. In one or more embodiments the set of instructions further cause the processor to select at least one transmitter module and at least one receiver module based, at least in part, on a sensitivity parameter for at least one of the first configuration and the second configuration. In one or more embodiments, at least one of the one or more modules of the first configuration and the second configuration comprise the tool module, wherein the tool module comprises a telemetry module. In one or more embodiments, at least one of the first configuration and the second configuration comprises the transmitter module, the receiver module, the space module, the gap sub module, and the tool module, wherein the tool module comprises at least one telemetry module. In one or more embodiments, at least one of the first configuration and the second configuration comprises two transmitter modules and two receiver modules, wherein the receiver modules are on either side of the transmitter modules, and wherein the two receiver modules comprise at least one of a coil or magnetometer.

In one or more embodiments, non-transitory computer readable medium storing a program that, when executed, causes a processor to receive one or more of the collected parameters, wherein the one or more collected parameters comprise one or more ranging parameters, a frequency of a signal, a power level, a voltage level, a current level, a formation resistivity, a mud resistivity, and a borehole diameter, select at least one of one or more modules for a first configuration of a ranging tool based, at least in part, on at least one of the one or more collected parameters, and wherein the one or more modules comprise at least one of a transmitter module, a receiver module, a spacer module, a gap sub module, and a tool module, activate the at least one of the one or more modules of the first configuration, receive a first measurement associated with the first configuration, select at least one of the one or more modules for a second configuration of the ranging tool based, at least in part, on the one or more collected parameters and one or more operational conditions, activate the at least one of the one or more modules of the second configuration, receive a second measurement associated with the second configuration, calculate a ranging parameter based, at least in part, on the first measurement and the second measurement, and adjust at least one operational parameter based, at least in part, on the calculated ranging parameter. In one or more embodiments, the program when executed further causes the processor to compare a simulated signal from a target to a noise level for each of the first configuration and the second configuration and discard a configuration with a signal strength of the signal from the target lower than that of the noise level. In one or more embodiments, the program when executed further causes the processor to analyze operational efficiency for each of the first configuration and the second configuration based, at least in part, on the one or more collected parameters and select a configuration one of the first configuration or the second configuration based, at least in part, on the analyzed operational efficiency for each of the first configuration and the second configuration. In one or more embodiments, analyzing the operational efficiency for each of the first configuration and the second configuration comprises performing electromagnetic simulations for each of the first configuration and the second configuration. In one or more embodiments, the program when executed further causes the processor to collect the at least one of the one or more collected parameters by making a downhole measurement using the selected configuration and determine at least one of a distance, a direction and an orientation to a target based, at least in part, on the downhole measurement. In one or more embodiments, the program when executed further causes the processor to adjust a drilling parameter based, at least in part, on the determined at least one of the distance, the direction and the orientation to the target. In one or more embodiments, the program when executed further causes the processor to analyze one or more operational constraints, wherein the one or more operational constraints comprise at least one of drilling rate, bending radius, bottom hole assembly length, total power consumption associated with each configuration, wherein analyzing the operational efficiency for each of the first configuration and the second configuration is based, at least in part on the analyzed operational constraints. In one or more embodiments, the program when executed further causes the processor to select at least one of the transmitter module and at least one of the receiver module based, at least in part, on a sensitivity parameter for at least one of the first configuration and the second configuration. In one or more embodiments, at least one of the one or more modules of the first configuration and the second configuration comprise the tool module, wherein the tool module comprises a telemetry module. In one or more embodiments, at least one of the first configuration and the second configuration comprises the transmitter module, the receiver module, the space module, the gap sub module, and the tool module, wherein the tool module comprises at least one telemetry module. In one or more embodiments, at least one of the first configuration and the second configuration comprises two transmitter modules and two receiver modules, wherein the receiver modules are on either side of the transmitter modules, and wherein the two receiver modules comprise at least one of a coil or magnetometer.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method for downhole ranging within a formation, the method comprising:

requesting one or more collected parameters, wherein the one or more collected parameters are requested based on a predicted operating condition for an operation;

receiving one or more collected parameters, wherein the one or more collected parameters comprise one or more ranging parameters, a frequency of a signal, a power level, a voltage level, a current level, a formation resistivity, a mud resistivity, and a borehole diameter;

determining a first configuration of a ranging tool positioned in a borehole, wherein the ranging tool comprises one or more modules, wherein each of the one or more modules are selectable and activatable, wherein the one or more modules are modular, and wherein determining the first configuration comprises:

selecting at least one of the one or more modules for the first configuration while the ranging tool is positioned in the borehole based, at least in part, on at least one of the one or more collected parameters, wherein the one or more modules comprise at least one of a transmitter module, a return module, a receiver module, a spacer module, a gap sub module, and a tool module;

activating at least one of the one or more modules of the first configuration of the ranging tool while the ranging tool is positioned in the borehole;

receiving a first measurement associated with the first configuration of the ranging tool;

determining a second configuration of the ranging tool, wherein determining the second configuration comprises:

selecting at least one of the one or more modules for the second configuration while the ranging tool is positioned in the borehole based, at least in part, on the one or more collected parameters and one or more operational conditions;

activating the at least one of the one or more modules of the second configuration of the ranging tool while the ranging tool is position in the borehole;

receiving a second measurement associated with the second configuration of the ranging tool;

analyzing operational efficiency for each of the first configuration and the second configuration based, at least in part, on the one or more collected parameters;

selecting a configuration from one of the first configuration or the second configuration based, at least in part, on the analyzed operational efficiency for each of the first configuration and the second configuration;

calculating a ranging parameter based, at least in part, on the first measurement and the second measurement; and adjusting at least one operational parameter based, at least in part, on the calculated ranging parameter.

2. The method of claim 1, further comprising:

comparing a simulated signal from a target to a noise level for each of the first configuration and the second configuration; and discarding a configuration with a signal strength of the signal from the target lower than that of the noise level.

3. The method of claim 1, wherein analyzing the operational efficiency for each of the first configuration and the second configuration comprises performing electromagnetic simulations for each of the first configuration and the second configuration.

4. The method of 1, further comprising:

collecting the at least one of the one or more collected parameters by making a downhole measurement using the selected configuration; and determining at least one of a distance, a direction and an orientation to a target based, at least in part, on the downhole measurement.

5. The method claim 4, further comprising adjusting a drilling parameter based, at least in part, on the determined at least one of the distance, the direction and the orientation to the target.

6. The method of claim 1, further comprising analyzing one or more operational constraints, wherein the one or more operational constraints comprise at least one of drilling rate, bending radius, bottom hole assembly length, total power consumption associated with each configuration, and wherein analyzing the operational efficiency for each of the first configuration and the second configuration is based, at least in part on the analyzed operational constraints.

7. The method of claim 1, further comprising selecting at least one of the transmitter module and at least one of the receiver module based, at least in part, on a sensitivity parameter for at least one of the first configuration and the second configuration.

8. The method of claim 1, wherein at least one of the one or more modules of the first configuration and the second configuration comprise the tool module, wherein the tool module comprises a telemetry module.

9. The method of claim 1, wherein at least one of the first configuration and the second configuration comprises the transmitter module, the receiver module, the spacer module, the gap sub module, and the tool module, wherein the tool module comprises at least one telemetry module.

10. The method of claim 1, wherein at least one of the first configuration and the second configuration comprises two transmitter modules and two receiver modules, wherein the receiver modules are on either side of the transmitter modules, and wherein the two receiver modules comprise at least one of a coil or magnetometer.

11. A wellbore drilling system for drilling in a subsurface earth formation, comprising:

a ranging tool coupled to a drill string;

an information handling system communicably coupled to the ranging tool, the information handling system comprises a processor and memory device coupled to the processor, the memory device containing a set of instruction that, when executed by the processor, cause the processor to:

request one or more collected parameters, wherein the one or more collected parameters are requested based on a predicted operating condition for an operation;

receive the one or more of the collected parameters, wherein the one or more collected parameters comprise one or more ranging parameters, a frequency of a signal, a power level, a current level, formation resistivity, mud resistivity, and borehole diameter;

determine a first configuration of a ranging tool positioned in a borehole, wherein the ranging tool comprises one or more modules, wherein each of the one or more modules are selectable and activatable, wherein the one or more of modules are modular, and wherein determining the first configuration comprises:

selecting at least one of the one or more modules for the first configuration while the ranging tool is positioned in the borehole based, at least in part, on at least one of the one or more collected parameters, wherein the one or more modules comprise at least one of a transmitter module, a receiver module, a spacer module, a gap sub module, and a tool module;

activate the at least one of the one or more modules of the first configuration of the ranging tool while the ranging tool is positioned in the borehole;

receive a first measurement associated with the first configuration;

determine a second configuration of the ranging tool, wherein determining the second configuration comprises:

selecting at least one of the one or more modules for the second configuration while the ranging tool is positioned in the borehole based, at least in part, on the one or more collected parameters and one or more operational conditions;

activate the at least one of the one or more modules of the second configuration of the ranging tool while the ranging tool is positioned in the borehole;

receive a second measurement associated with the second configuration;

analyze operational efficiency for each of the first configuration and the second configuration based, at least in part, on the one or more collected parameters;

select a configuration from one of the first configuration or the second configuration based, at least in part, on the analyzed operational efficiency for each of the first configuration and the second configuration;

calculate a ranging parameter based, at least in part, on the first measurement and the second measurement; and adjust at least one operational parameter based, at least in part, on the calculated ranging parameter.

12. The wellbore drilling system of claim 11, wherein the set of instructions further cause the processor to:

compare a simulated signal from a target to a noise level for each of the first configuration and the second configuration; and discard a configuration with a signal strength of the signal from the target lower than that of the noise level.

13. The wellbore drilling system of claim 11, wherein analyzing the operational efficiency for each of the first configuration and the second configuration comprises performing electromagnetic simulations for each of the first configuration and the second configuration.

14. The wellbore drilling system of claim 11, wherein the set of instructions further cause the processor to:

collect the at least one of the one or more collected parameters by making a downhole measurement using the selected configuration; and determine at least one of a distance, a direction and an orientation to a target based, at least in part, on the downhole measurement.

15. The wellbore drilling system of claim 14, wherein the set of instructions further cause the processor to adjust a drilling parameter based, at least in part, on the determined at least one of the distance, the direction and the orientation to the target.

16. The wellbore drilling system of claim 11, wherein the set of instructions further cause the processor to analyze one or more operational constraints, wherein the one or more operational constraints comprise at least one of drilling rate, bending radius, bottom hole assembly length, total power consumption associated with each configuration, and wherein analyzing the operational efficiency for each of the first configuration and the second configuration is based, at least in part on the analyzed operational constraints.

17. The wellbore drilling system of claim 11, wherein the set of instructions further cause the processor to select at least one transmitter module and at least one receiver module based, at least in part, on a sensitivity parameter for at least one of the first configuration and the second configuration.

18. The wellbore drilling system of claim 11, wherein at least one of the one or more modules of the first configuration and the second configuration comprise the tool module, wherein the tool module comprises a telemetry module.

19. The wellbore drilling system of claim 11, wherein at least one of the first configuration and the second configuration comprises the transmitter module, the receiver module, the space module, the gap sub module, and the tool module, wherein the tool module comprises at least one telemetry module.

20. The wellbore drilling system of claim 11, wherein at least one of the first configuration and the second configuration comprises two transmitter modules and two receiver modules, wherein the receiver modules are on either side of the transmitter modules, and wherein the two receiver modules comprise at least one of a coil or magnetometer.

21. A non-transitory computer readable medium storing a program that, when executed, causes a processor to:

request one or more collected parameters, wherein the one or more collected parameters are requested based on a predicted operating condition for an operation;

receive the one or more of the collected parameters, wherein the one or more collected parameters comprise one or more ranging parameters, a frequency of a signal, a power level, a voltage level, a current level, a formation resistivity, a mud resistivity, and a borehole diameter;

determine a first configuration of a ranging tool positioned in a borehole, wherein the ranging tool comprises one or more modules, wherein each of the one or more modules are selectable and activatable, wherein the one or more modules are modular, and wherein determining the first configuration comprises:

selecting at least one of the one or more modules for the first configuration while the ranging tool is positioned in the borehole based, at least in part, on at least one of the one or more collected parameters, wherein the one or more modules comprise at least one of a transmitter module, a receiver module, a spacer module, a gap sub module, and a tool module;

activate the at least one of the one or more modules of the first configuration while the ranging tool is positioned in the borehole;

receive a first measurement associated with the first configuration;

determine a second configuration of the ranging tool, wherein determining the second configuration comprises:

selecting at least one of the one or more modules for the second configuration while the ranging tool is positioned in the borehole based, at least in part, on the one or more collected parameters and one or more operational conditions;

activate the at least one of the one or more modules of the second configuration while the ranging tool is positioned in the borehole;

receive a second measurement associated with the second configuration;

analyze operational efficiency for each of the first configuration and the second configuration based, at least in part, on the one or more collected parameters;

select a configuration one of the first configuration or the second configuration based, at least in part, on the analyzed operational efficiency for each of the first configuration and the second configuration;

calculate a ranging parameter based, at least in part, on the first measurement and the second measurement; and adjust at least one operational parameter based, at least in part, on the calculated ranging parameter.

22. The non-transitory computer readable medium of claim 21, wherein the program, when executed, further causes the processor to:

compare a simulated signal from a target to a noise level for each of the first configuration and the second configuration; and discard a configuration with a signal strength of the signal from the target lower than that of the noise level.

23. The non-transitory computer readable medium of claim 21, wherein analyzing the operational efficiency for each of the first configuration and the second configuration comprises performing electromagnetic simulations for each of the first configuration and the second configuration.

24. The non-transitory computer readable medium of claim 21, wherein the program, when executed, further causes the processor to:

collect the at least one of the one or more collected parameters by making a downhole measurement using the selected configuration; and determine at least one of a distance, a direction and an orientation to a target based, at least in part, on the downhole measurement.

25. The non-transitory computer readable medium of claim 24, wherein the program, when executed, further causes the processor to adjust a drilling parameter based, at least in part, on the determined at least one of the distance, the direction and the orientation to the target.

26. The non-transitory computer readable medium of claim 21, wherein the program, when executed, further causes the processor to analyze one or more operational constraints, wherein the one or more operational constraints comprise at least one of drilling rate, bending radius, bottom hole assembly length, total power consumption associated with each configuration, wherein analyzing the operational efficiency for each of the first configuration and the second configuration is based, at least in part on the analyzed operational constraints.

27. The non-transitory computer readable medium of claim 21, wherein the program, when executed, further causes the processor to select at least one of the transmitter module and at least one of the receiver module based, at least in part, on a sensitivity parameter for at least one of the first configuration and the second configuration.

28. The non-transitory computer readable medium of claim 21, wherein at least one of the one or more modules of the first configuration and the second configuration comprise the tool module, wherein the tool module comprises a telemetry module.

29. The non-transitory computer readable medium of claim 21, wherein at least one of the first configuration and the second configuration comprises the transmitter module, the receiver module, the space module, the gap sub module, and the tool module, wherein the tool module comprises at least one telemetry module.

30. The non-transitory computer readable medium of claim 21, wherein at least one of the first configuration and the second configuration comprises two transmitter modules and two receiver modules, wherein the receiver modules are on either side of the transmitter modules, and wherein the two receiver modules comprise at least one of a coil or magnetometer.

* * * * *